US007267503B1

(12) United States Patent
Bentsen

(10) Patent No.: US 7,267,503 B1
(45) Date of Patent: Sep. 11, 2007

(54) ICE AND SNOW REMOVAL TOOL

(76) Inventor: David M. Bentsen, 326 W. Otis, Hazel Park, MI (US) 48030

( * ) Notice: Subject to any disclaimer, the term of this patent is extended or adjusted under 35 U.S.C. 154(b) by 0 days.

(21) Appl. No.: 11/504,264

(22) Filed: Aug. 15, 2006

(51) Int. Cl.
*A46B 11/00* (2006.01)
*A47L 1/08* (2006.01)

(52) U.S. Cl. ..... 401/123; 401/48; 401/138

(58) Field of Classification Search ..... 401/48, 401/118, 123, 131, 137, 138, 140
See application file for complete search history.

(56) References Cited

U.S. PATENT DOCUMENTS 3,041,655 A * 7/1962 Entler ..... 401/263
3,771,188 A 11/1973 Guth
4,303,348 A * 12/1981 O'Brien ..... 401/137
4,349,039 A * 9/1982 Egger ..... 134/167 C
D392,781 S * 3/1998 McKnight ..... D32/35
5,725,322 A * 3/1998 Evans ..... 401/42
5,727,580 A * 3/1998 Patterson ..... 134/115 R
5,943,796 A 8/1999 Hedstrom

* cited by examiner

*Primary Examiner*—David J. Walczak
(74) *Attorney, Agent, or Firm*—Chase Law Firm, L.C.

(57) ABSTRACT

An ice and snow removal tool includes a telescopically adjustable pole with cross members attached to one end. A container is suspended from one end of the cross member and a brush is attached to the opposite end of the cross member. A cable extends along the pole to the bottom of the container to permit the contents of the container to be poured onto the roof by pulling the cable.

2 Claims, 1 Drawing Sheet

ICE AND SNOW REMOVAL TOOL

FIELD OF THE INVENTION

The present invention relates to ice and snow removal tools and, more particularly, to a tool to remove ice dams and snow from the edge of a roof.

BACKGROUND

In cold climates, ice dams commonly form along the edge of a roof. An ice dam is a ridge of ice that forms along the edge of a roof and prevents melting snow from draining off the roof. The water backs up behind the ice dam and may leak into the home causing damage to walls, ceilings, insulation and other areas. Ice dams form when there is a temperature differential between the higher portions and lower portions of a roof. The roof's outside surface must be above 32° F. (0° C.) while the lower surfaces are below 32° F. (0° C.). Typically this occurs when the outside air temperature is in the low 20s (degrees Fahrenheit). Heat escapes from the house through the ceiling and walls into the attic space and heats the inside surface of the roof causing the snow to melt. The water from the melted snow runs down the outside surface of the roof and refreezes at the colder edge of the roof. The dam grows as it is fed by the melting snow above it. Water above the ice dam remains a liquid and begins to backup. This water finds cracks and openings in the roof covering and flows into the attic space of the house or structure.

Various devices have been proposed to control or eliminate snow accumulation and ice dams. Such devices include electric heating systems using resistive heating wires, strips or other elements. These systems are expensive and often require professional installation. Other manual systems include blades to cut or chop the ice and snow, and scrapers to pull the ice or snow from the roof. These devices are often bulky, heavy and are prone to damaging the roof in order to remove the ice. Accordingly, there is a need for a lightweight device to remove ice dams which doesn't damage the roofing material.

SUMMARY

The present invention includes an extendable pole with a pair of arms extending from one end of the pole. A container is secured to the end of one of the arms and means are provided for pivoting or emptying the container to dispense the contents of the container. The container holds a de-icing solution or material that may be spread over an ice dam. The other arm includes a brush extending therefrom which may be used to spread the de-icing solution or material over the ice dam, and to sweep snow from the edge of the roof.

DETAILED DESCRIPTION

Figure 1:
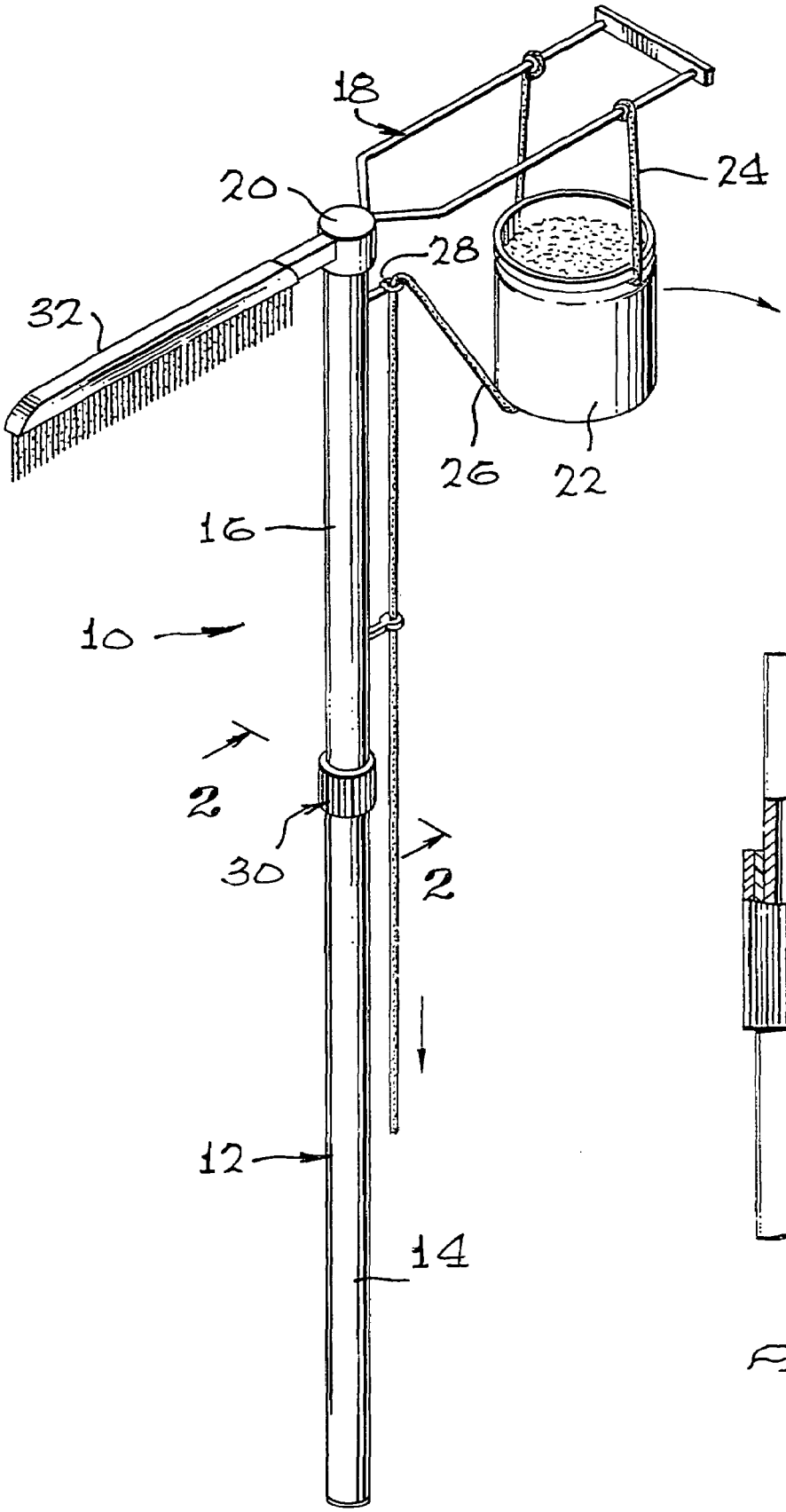
FIG. 1 is a perspective view of an ice removal apparatus of the present invention.
Figure 2:
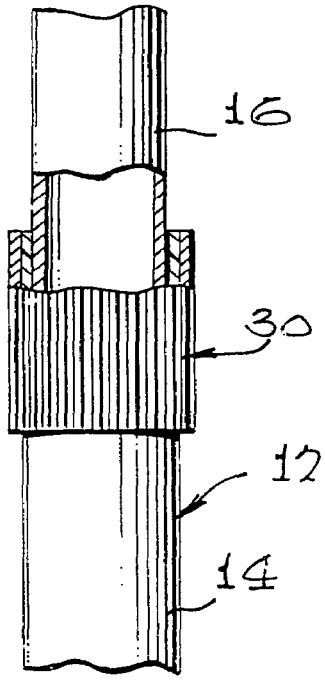
FIG. 2 is a partial cross sectional view taken along line 2-2, illustrating a locking telescoping nature of the pole of the apparatus.

Referring to FIGS. 1 and 2, the ice and snow removal tool of the present invention is generally indicated by reference numeral 10. The ice and snow removal tool 10 allows the user to safely stand on the ground adjacent to a building and remove ice and snow from the edge of the building's roof. The ice and snow removal tool 10 includes a pole 12 with a lower tube section/member 14 defining a handle portion and an upper tube section/member 16. Tube section 16 telescopically fits within tube section 14 so as to extend the length of the pole 12. Generally, each section of the pole 12 is approximately six feet in length so that the overall length of the pole may be adjusted from between six feet and 12 feet in length. The pole 12 is preferably made from a durable, lightweight material, such as plastic or aluminum.

A cross member having first and second arms is secured to the end of the pole 12 to form a generally T-shaped member.

A first arm 18 extends from the end 20 of pole 12. A container or bucket 22 is suspended from a free end of the arm 18 by a pair of ropes 24. A cable 26 is attached to a bottom portion of the container 22 and extends downwardly towards the opposite end of the pole 12 such that the user can easily grasp the cable 26. The cable 26 is threaded through a cable guide such as an eyelet 28 (or pulley, not shown) positioned toward the end 20 of the pole 12 so that as the cable 26 is pulled downwardly, the container 22 is tipped to dispense the contents therefrom. It should be understood by one of ordinary skill in the art that the means for pivoting and tipping the container 22 which have been described and illustrated herein are merely an example of the now preferred embodiment. Other means of pivoting and emptying the contents of the container 22 suspended from arm 18 extending from the end 20 of the pole 12 may also be used.

Pole 12 includes a locking mechanism 30, such as a twist compression lock shown in the figures. Twist compression lock 30 allows the length of pole 12 to be adjusted by sliding the upper tube section 16 into or out of the lower tube section 14 to a desired length and lock in place.

The ice and snow removal tool 10 also includes a brush 32 extending from the end 20 of the pole 12 opposite of arm 18. The brush 32 may be a nylon, polyester or natural fiber tipped brush, for example.

In use, a de-icing solution or ice melt material is placed in the container 22. The pole 12 is adjusted to the proper length to position the container 22 over an area containing ice and snow along the edge of a roof. The user grasps the cable 26 to tip the container 22 to empty the de-icing material or solution on the ice and snow. The brush 32 may be used to evenly spread the de-icing material or solution along the roof edge to melt the ice. The brush 32 may also be used to sweep away accumulated snow and to remove the remaining ice after the de-icing solution has at least partially melted the ice.

Although the invention has been described above as relating to snow and ice removal, the apparatus 10 may also be used to clean debris from gutters, such as leaves and twigs. The container 22 may be used to pour water or soap solutions into the gutter system and the brushing tool 32 may be used to clean the dirt and debris from the gutter.

It is to be understood that while certain forms of this invention have been illustrated and described, it is not limited thereto, except in so far as such limitations are included in the following claims and allowable equivalents thereof.

The invention claimed is:

1. A tool for removing ice and snow from the lower periphery of a roof, said tool comprising:

a pole having a first member and a second member, said first member adapted to receive said second member, said second member having a free end and extendable from said first member between a retracted position and an extended position, a twist compression lock secured to an end of said first member for releasably locking said second member in said extended position, a first arm extending generally perpendicularly from said free end of said second member and having a free end, a container pivotally suspended from said free end of said first arm, said container adapted to hold a de-icing material, a cable guide attached to said second member of said pole, a cable secured to a bottom portion of said container and extending from said container through said cable guide to said first member of said pole, and a brush extending generally perpendicularly from said free end of said second member opposite said first arm, whereby said pole is lengthened to extend said first arm over the lower periphery of the roof, whereby said cable is pulled by a user to tip said container to dispense the de-icing material along the lower periphery of the roof, and whereby said pole is rotated to extend said brush over the lower periphery of the roof to distribute said de-icing material.

2. A tool for removing undesired material from a gutter attached to the periphery of a roof, said tool comprising:

a telescopically extending pole lockingly extendable between a retracted position and an extended position, and having a handle portion and an end opposite said handle portion, a cross member secured to said end of said pole to form a generally T-shaped member, said cross member having first and second arms, an open container pivotally secured proximal an end of said first arm and having a bottom, said open container for holding a removal material, a brush extending from said second arm of said cross member, a first eyelet attached proximal said end of said pole beneath said first arm, a cable having a first end attached to said bottom of said container and a free end extending from said bottom of said container through said eyelet and along said pole to said handle portion, whereby said pole is telescopically extended and rotated to position said container over the gutter, whereby said free end of said cable is pulled by a user thereby pivoting said container to dispense said removal material, and whereby said pole is rotated to position said brush over said gutter to spread said removal material.

* * * * *